United States Patent [19]

Stewart

[11] Patent Number: 4,909,394

[45] Date of Patent: Mar. 20, 1990

[54] NESTABLE LOCKABLE FOAMED THERMOPLASTIC CONTAINER OR CUP

[75] Inventor: Ian R. Stewart, Toronto, Canada

[73] Assignee: Citylink Group Limited, Perivale, England

[21] Appl. No.: 244,856

[22] Filed: Sep. 15, 1988

Related U.S. Application Data

[63] Continuation of Ser. No. 9,552, Jan. 30, 1987, abandoned, which is a continuation of Ser. No. 727,670, Apr. 26, 1985, abandoned.

[51] Int. Cl.[4] ..... B65D 21/02

[52] U.S. Cl. ..... 206/520; 206/217; 229/1.5 B

[58] Field of Search ..... 206/217, 519, 520; 229/1.5 B

[56] References Cited

U.S. PATENT DOCUMENTS 4,156,483 3/1979 Day ..... 206/217

FOREIGN PATENT DOCUMENTS 1554241 3/1976 United Kingdom ..... 206/520

2076278 12/1981 United Kingdom ..... 206/520

*Primary Examiner*—George E. Lowrance

*Attorney, Agent, or Firm*—James D. Fornari; Ivor M. Hughes

[57] ABSTRACT

A resilient, yieldable, nestable, tapered, foamed thermoplastic container or cup is provided each cup or container having an endless groove and endless lug extending from the inside and outside surfaces of the container or cup wall, the groove penetrating the container or cup wall. The endless lug extends a distance from the cup wall greater than the distance the groove penetrates into the cup wall by about several thousandths of an inch (a few thousandths of a centimeter). The groove comprises a horizontally extending lower locating ledge for preventing a cup nesting therewith being pushed in below the ledge, a substantially vertically extending intermediate sealing surface meeting an entry/retaining ramp angled to the vertical at an angle greater than about 10 degrees, which allows the lug to be gradually introduced into the groove and then inhibits axial separation, the lug being rounded in cross-section and being radially compressible when it engages the intermediate sealing surface to seal the two together, the vertical height of the groove from the ledge and thus the height of the intermediate sealing surface being greater than the height of the lug to ensure there is no axial force on the lug when accommodated by the groove. With this construction like cups can be separated and sealed a number of times.

24 Claims, 4 Drawing Sheets

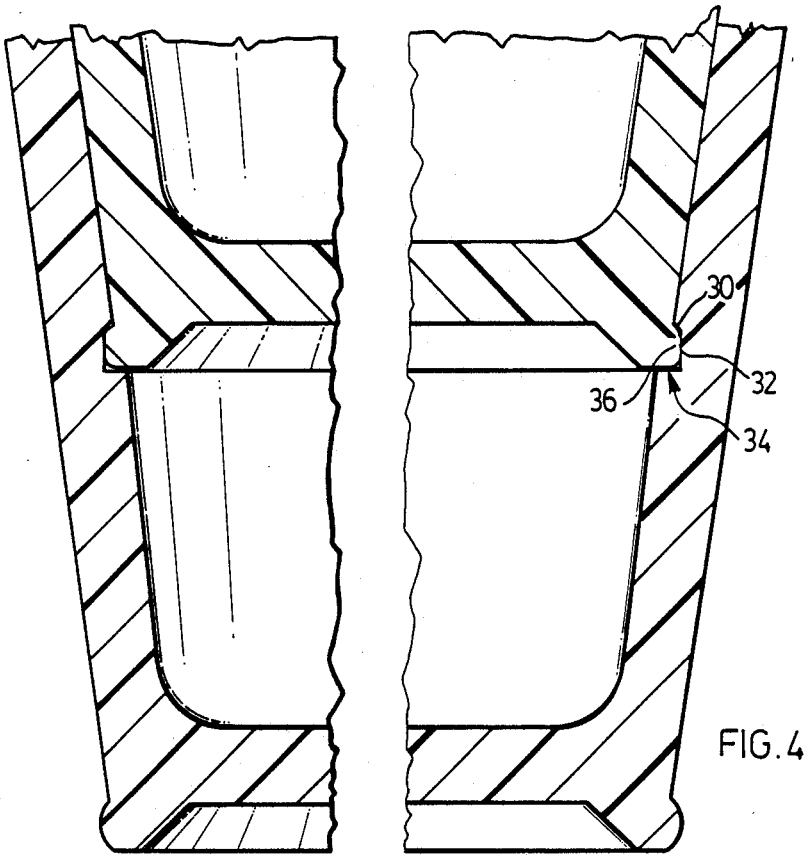
FIG. 4.
FIG. 5.
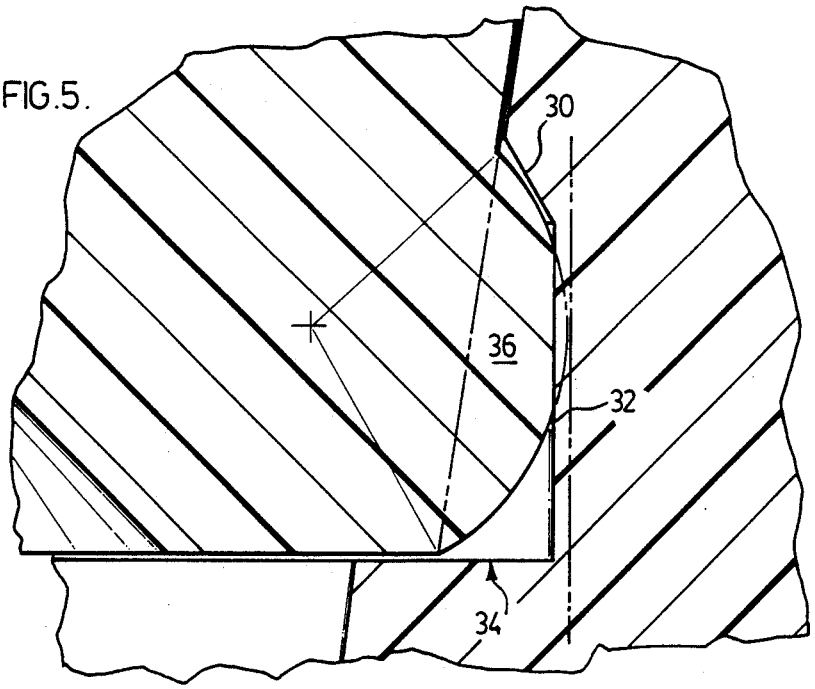

NESTABLE LOCKABLE FOAMED THERMOPLASTIC CONTAINER OR CUP

CROSS REFERENCE TO RELATED APPLICATIONS

This application is a continuation of Ser. No. 07/009,552, filed Jan. 30, 1987, which is a continuation of Ser. No. 06/727,670, filed Apr. 26, 1985, both now abandoned.

FIELD OF INVENTION

This invention relates to foamed thermoplastic cups nestable one into the other and lockable together sealing the space therebetween from the atmosphere.

BACKGROUND OF INVENTION

There is a growing demand for vending machines which dispense both hot and cold beverages made from fresh ingredients. Different approaches have been taken to protect the ingredients in the dispenser. One approach is the storage of bulk concentrate which is discharged into a cup as needed and water is added. The drawbacks with this approach are, the constant atmospheric contact with the concentrate with consequent increase of moistness and loss of flavour, and the variance of the amount of concentrate discharged into each cup.

A different and newer approach has been to provide stacks of beverage concentrate-containing foamed thermoplastic cups stored for dispensing by vending machines, each cup containing a premeasured amount of beverage concentrate. A wedging action holding the upper up in the lower cup is supposed to seal the comestible from the atmosphere (see U.S. Pat. No. 4,096,947, for example). However, that is not the case as no effective seal is provided.

In another attempt to protect the comestible from the atmosphere, U.S. Pat. No. 4,156,483 (Day) teaches, in a stack of expanded or foamed polystyrene vending cups (each cup having a wall thickness typically in the range of 1.0 to 3.0 mm), containing a comestible between adjacent cups, the use of an angular lug on the outer surface of the cup at the bottom, and a like angularly shaped groove having an entry ramp on the inside of the cup terminating at a radially extending upwardly facing sealing ledge or surface. In use, the upper cup is pushed into a lower cup so that when the lug enter the groove, the entry ramp allegedly engages the upper surface of the lug and forces the bottom of the lug to seat on the ledge to seal the space between the cups. In other words, the entry ramp of the groove is alleged to push against the sloped upper portion of the lug to cause the bottom of the lug to seal against the upper surface of the ledge when the lug is in the groove and seats on the ledge. The difficulty with this approach is the material being worked with. The expansion of the polystyrene beads is uneven. If the groove is oversized or the lug undersized there can be no seal. If the groove is undersized or the lug oversized because the sealing action proposed by Day in his U.S. Pat. No. 4,156,483 (see FIGS. 1, 3, 6, 8, 9 and 10) is purported to be in the axial direction, there is not adequate allowance for compressed material and the cups will have a tendency to separate as the lug and groove naturally try to assume their original separate configurations and dimensions. Additionally, the fused and expanded bead material is subject to cracking and chipping when overly stressed, breaking off and falling into the cup.

German Pat. No. 2,639,929 teaches the use of a circular lug on the outer surface of the cup at the bottom and a like shaped circular groove on the inside wall of the cup. In use, an upper cup is pushed into a lower cup until the lug enters the groove sealing the space between an upper add lower cup.

With regard to the structure shown in FIG. 4 of U.S. Pat. No. 4,156,483, a "<-shaped" lug on the outer surface of the cup at the bottom and a like shaped "<-shaped" groove on the inside wall of the cup are provided as part of the proposal for receiving the "<-shaped" lug of a like upper cup.

Once again the difficulty with these last-mentioned approaches is the material Manfred Rothkegel and Day are working with. The expansion of the polystyrene beads is uneven and the fused and expanded material is subject to cracking and chipping when overly stressed, breaking off and falling into the cup.

Because it is impossible from a practical point of view to consistently manufacture equally sized lugs and grooves, the purported "equally sized grooves and lugs" cannot provide an effective seal. If the lug of one of a pair of ups is larger than the groove of the other cup it is being forced into, the cups will tend to "pop" apart as the compressed expanded thermoplastic material resumes its original configuration and dimensions, thus preventing a seal. If the lug is of the same configuration but smaller than the groove, there will be no seal between the two cups.

With respect to the manufacture of the Day lug, the lug profile must be cut into the female mould cavity in order to manufacture the cup. Cutting angular grooves into the mould causes notch-type stress concentrations and subsequent failure when the mould is stressed during operation. While this problem can be overcome by making the mould cavity thicker, this increases the operating cycle time. The problem could also be overcome by using a two-part cavity but this modification significantly increases mould cost.

Not only must the lug enter the groove without breaking or being compressed beyond its ability to restore, it must be easily dislodged Therefrom. In many instances, part of the lug is broken off and falls into the beverage liquid.

Therefore, for a cup to be a truly locking and sealing cup when inserted one into the other for sealing the commestibles carried at the bottom of the lowermost cup by a lug carried by one of the cups entering a groove in the other cup, the cups when nested must accommodate the compressed material between the lug and groove, must not overcompress the material of the lug and groove to be able to resume their original configuration for sealing the space between the nested cups, the seal must be complete yet the cups must easily separate without breakage of material from the lug and the cups must be able to seal and separate at least three times during manufacture and dispensing without damaging the material of the lug.

It is therefore an object of this invention to provide an improved foamed thermoplastic cup having an improved lug and groove configuration which overcomes the aforementioned difficulties of the prior art proposals, is easily manufactured at minimum cost, and provides an effective seal between two like cups when nested together yet provides such effective seal between the two cups in a manner that the lowermost cup may be easily dislodged from the upper cup by axial downward force on the rim of the lowermost cup.

Further and other objects of this invention will be realized by those skilled in the art from the following summary of the invention and detailed description of an embodiment of the invention.

SUMMARY OF INVENTION

According to one aspect of the invention, a resilient, yieldable, nestable, tapered, foamed thermoplastic (preferably expanded polystyrene) cup or container are provided, each cup or container having an endless groove and endless lug extending from the inside and outside surfaces of the container or cup wall, the groove penetrating the container or cup wall through either the inner or outer surface of the cup wall a predetermined distance from the other bottom of the container or cup, tee endless lug extending from the other surface of the cup wall for locking in the groove of a like container or cup when nested with the other container or cup, the endless lug extending a distance from the cup wall greater than the distance the groove penetrates into the cup wall by about several thousandths of an inch (a few thousandths of a centimeter) (and preferably of its maximum width proximate the centre of the lug), the groove comprising a horizontally extending lower locating ledge for preventing a .cup nesting therewith to be pushed in below the ledge, a substantially vertically extending intermediate sealing surface meeting an entry/retaining ramp thereabove which allows the lug to be gradually introduced into the groove and then inhibits axial separation, the ramp being angled to the vertical at an angle greater than about 10 degrees, and preferably an angle between about 12 degrees and about 45 degrees to the vertical, and most preferably at an angle of about 15 degrees to the vertical, the lug being rounded (for example, circular) in cross-section and being radially compressible when it engages the intermediate sealing surface to seal the two together, the vertical height of the groove from the ledge and preferably the height of the intermediate sealing surface being greater than the height of the lug to ensure there is no axial force on the lug when accommodated by the groove and only a central to provide a narrow surface intense pressure area between the cups so that any compressed lug material is displaced in the groove which groove accommodates displaced compressed material whereby the creation of a radially extending seal being in the form of a narrow band between the lug and sealing surface is facilitated between two cups or containers (without undue distortion or compression of the expanded thermoplastic material) providing a clearance between either or both the entry/retaining ramp and lower locating ledge, and which cups or containers are easily separated without the breaking off of lug material.

Thus, the above structural configuration provides a cup or container which is simple to manufacture, provides an effective seal, will have minimum tendency to chip, and carries a lug which deforms predictably when compressed into the groove, is accommodated by the groove and has no axial forces on the lug tending to push the lug out of the groove.

According to another aspect of the invention, when the groove penetrates the outside surface of the container or cup wall, the endless lug extends inwardly from the inside surface of the cup wall and is of an inner diameter at its maximum width slightly less than the diameter of the groove at its maximum penetration into the container or cup wall. Additionally, the entry/-retaining ramp of the groove is adjacent the bottom of the groove and that part of the groove wall extends upwardly and radially inwardly to the intermediate sealing surface of the groove.

According to another aspect of the invention, when the groove penetrates the inside surface of the container or cup wall, the endless lug extends outwardly from the outside surface of the container or cup wall and is of an outer diameter at its maximum width slightly greater than the diameter of the groove at its maximum penetration into the container or cup wall. Additionally, the entry/retainer ramp is at the top of the groove and that part of the groove extends downwardly and radially outwardly to the intermediate sealing surface.

Therefore, when two containers or cups are to be nested, the upper container or cup is pressed into the lower container or cup with the lug being slightly compressed by the inner tapered wall of the lower container or cup until it tries to resume its original configuration a it enters the groove. When it enters the groove, facilitated by the entry and exit ramp of the groove, the lug creates a compression seal with the intermediate sealing surface of the groove. Because the lug extends a greater distance from the cup wall than the groove penetrates the wall by several thousandths of an inch, the widest portion of the lug is compressed and forms a seal with the intermediate seating surface. Any displaced lug material is accomodated in the groove. Further pushing of the upper cup into the lower cup is restricted by the horizontally extending ledge. Under normal conditions, the entry/retainer ramp prohibit separation of the cups until a suitable dispensing force is applied to the lower cup in which event the cup is easily separated from the upper cup, by the lug climbing the entry/retainer without breaking the lug. In one embodiment, each of the foamed thermoplastic cups has a cup wall thickness of 2.0 mm, an outer radius at its mouth of 80 mm, an outer radius at its base of 54.25 mm, a base thickness of 2.5 mm, a wall slope of 8 degrees 15' to the vertical with the slope of the inner surface of the wall of the cut below the groove being 6 degrees, and a cup height of 375 mm. In this embodiment the lug is disposed on the outer surface at the bottom of the cup, forms part of a circle in cross-section is 1.65 mm in height and 0.64 mm in width and has a radius of 1.0 mm. In this embodiment the groove has a depth at its top end of 0.11 mm, a depth at the bottom of 0.70 mm, an entry ramp of 15 degrees to the vertical and about 0.5 mm in length, for example 0.53 mm in length, an intermediate sealing surface 1.22 mm and a horizontal ledge 0.70 mm wide at the bottom of the groove 9.4 mm from the bottom of the cup.

The invention will now be illustrated having regard to the embodiment of the invention disclosed in the drawings, and described in the detailed description of the embodiment of the invention.

Figure 2:
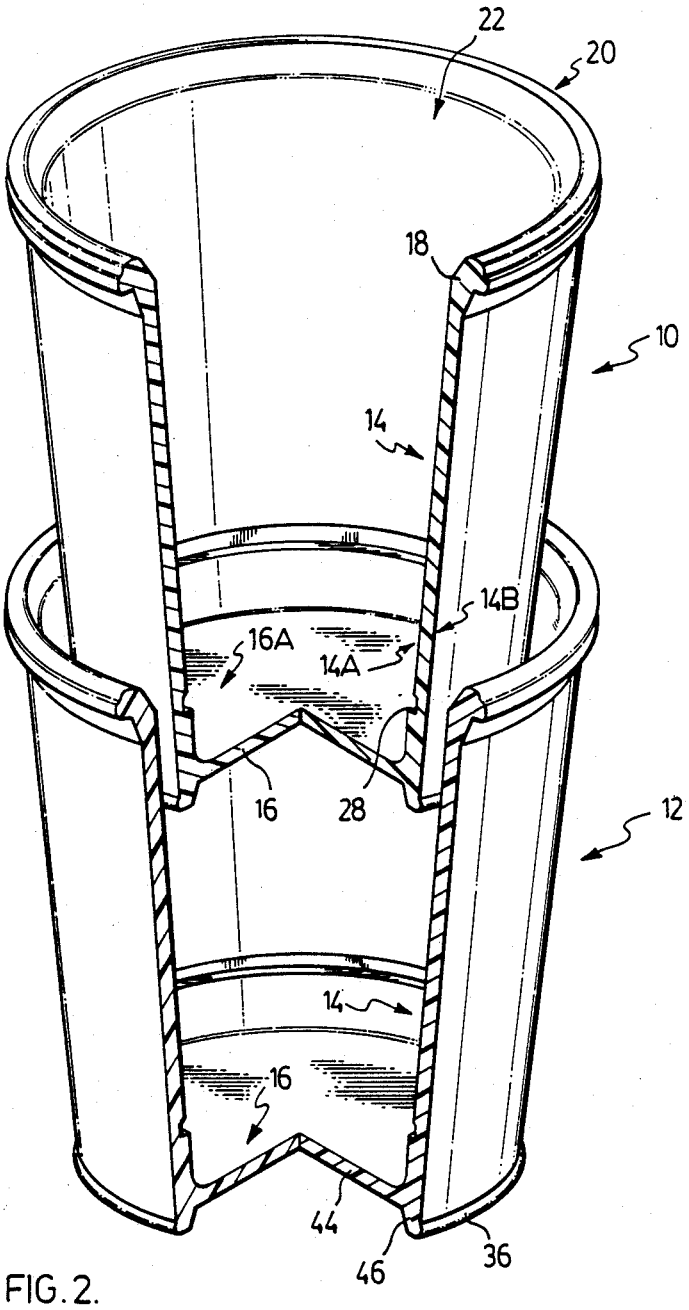
FIG. 2 is a perspective view of a stack of two cups according to the preferred embodiment of the invention, of FIG. 1 partly in cross-section to show the cross-section of the cup wall and bottom of each cup. a cross-section taken of one of the two nested cups of FIG. 2 according to the preferred embodiment of the invention shown in FIGS. 1 and 2.
Figure 6:
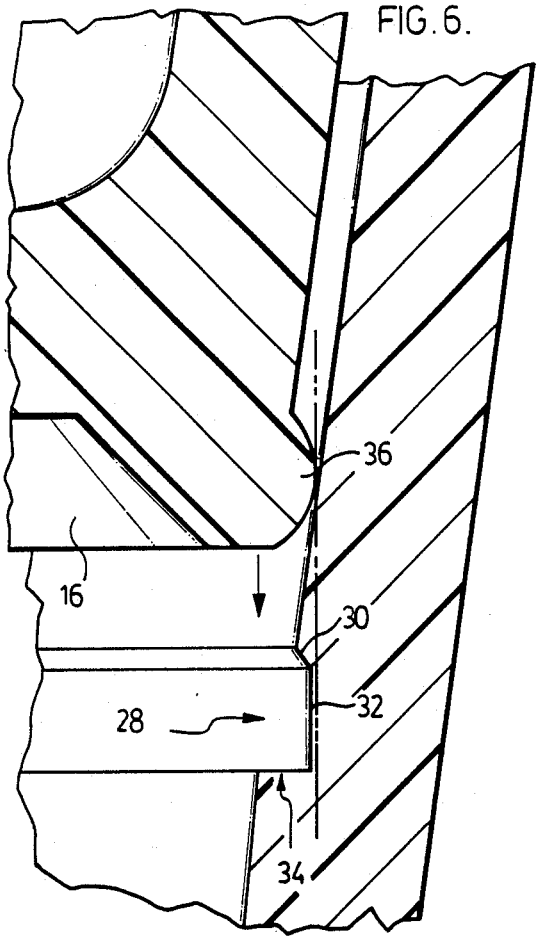
Figure 7:
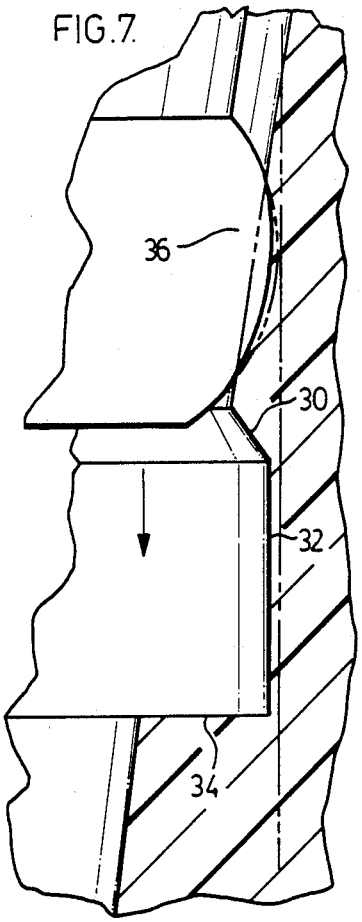
Figure 8:
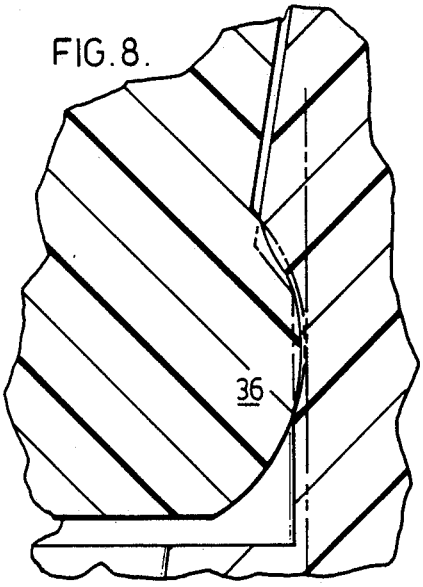
Figure 9:
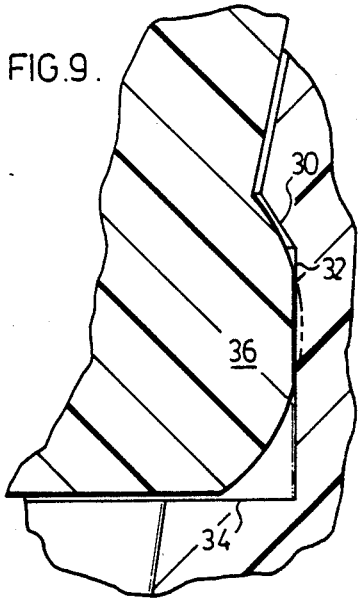

FIG. 4 is a close-up view of the two cups in cross-section shown in FIG. 2 nested.

FIG. 5 is a close-up of part of the structure shown in FIG. 4.

FIGS. 6 to 9 inclusive are cross-sectional close-up views of parts of two cups being nested together to seal the space therebetween.

DETAILED DESCRIPTION OF EMBODIMENTS

Figure 1:
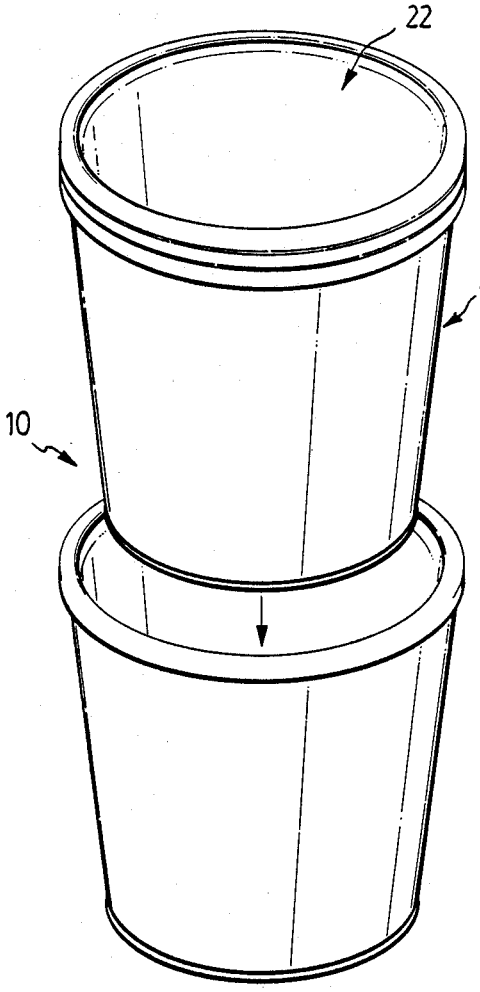
FIG. 1 is a perspective view of a stack of two cups nested one into the other according to a preferred embodiment of the invention.
Figure 3:
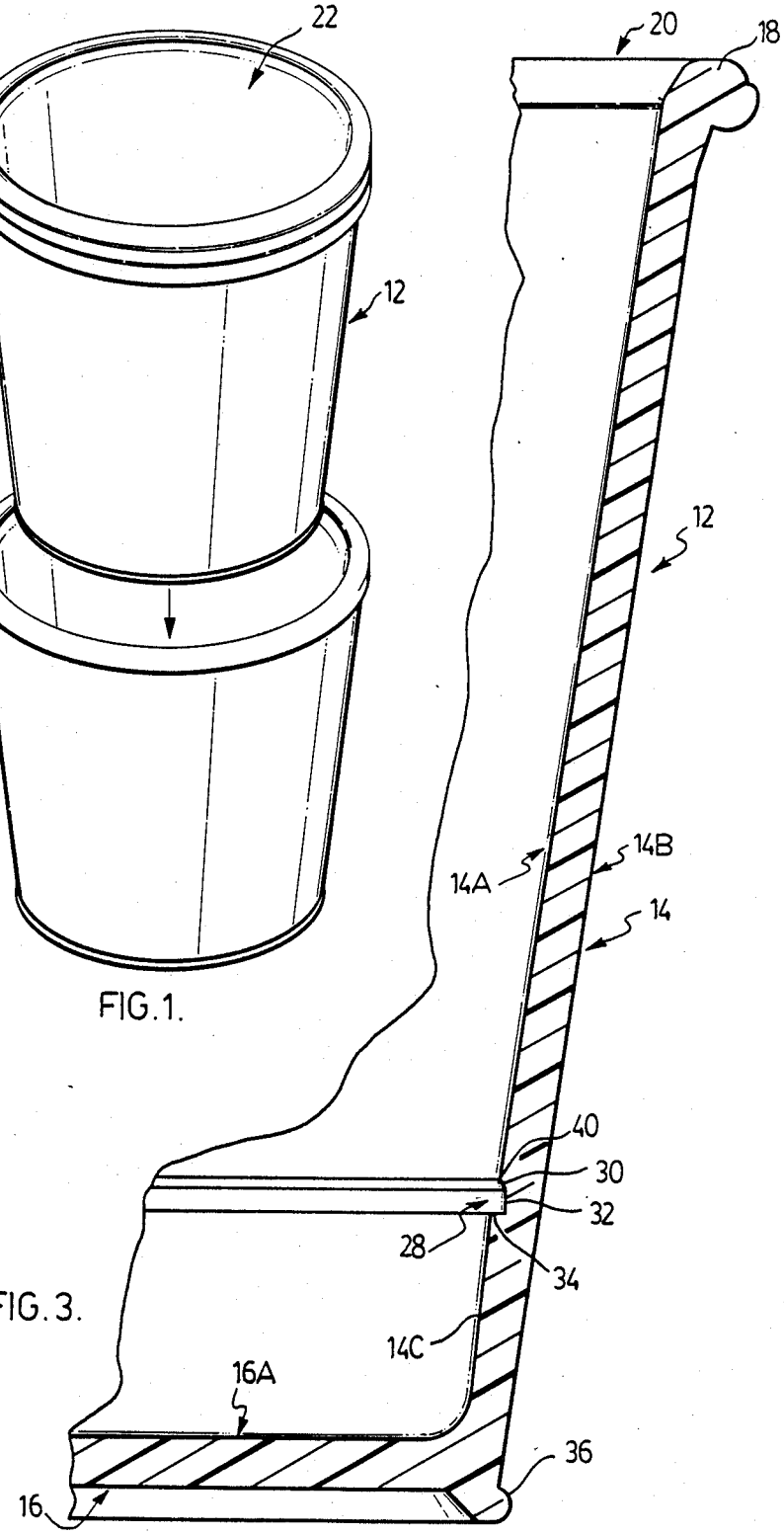

With reference to FIGS. 1 and 2, there is shown a stack of two cups 10, each cup 12 (shown best in FIGS. 2, 3, and 4) being made of resilient, yieldable, foamed, thermoplastic polystyrene material and having a side wall 14, bottom 16, and upper circular lip 18 formed at rim 20 defining mouth 22.

Extending outwardly from the inner surface 14A of cup 12 and spaced 9.4 mm from the upper surface 16A of bottom 16 is the lower extent of endless groove 28 having radially outwardly sloped entry/retainer ramp 30, sloped at 15 degrees to the vertical, and being 0.53 mm long, vertically oriented intermediate sealing surface 32, 1.22 mm long therebelow, and horizontally outwardly directed ledge 0.70 mm long and 9.4 mm above base 16.

Proximate bottom 16 of cup 12 endless protuberance or lug 36 extends from the outer surface 14B of side wall 14, endless, lug 36 being a portion of a circle having a radius of 1.0 mm and extending 0.64 mm from the surface 14B of wall 14 and being 1.65 mm in height.

The taper of the inner wall and outer wall of each cup is 8 degrees 15' to the vertical except with respect to the inner wall portion 14C between groove 28 and bottom 16 which is angled at 6 degrees to the vertical. Wall 14C is 9.4 mm in length.

Bottom 16 of cup 12 has transverse or horizontal portion 44 spaced from the bottom lug 36, and angled portion 46 angled 15 degrees to the horizontal, connecting lug 36 to the horizontal portion 44. Each cup has outer and inner diameters at its mouth 22 of 80 mm and 70.5 mm respectively and outer and inner diameters at the bottom of 54.25 mm and 50 mm respectively.

In use of the cups to store comestibles and seal the comestible against the atmosphere, the ingredients are deposited in the bottom of one cup 12 and another cup 12 is inserted into the cup containing the comestible. As the upper cup is pressed into the lower cup, lug 36 begins to be compressed by its engagement with inner side wall surface 14A of the outer cup 12 (see FIGS. 6 and 7) also compressing the foamed thermoplastic material of the portion of wall 14 engaged (see FIG. 7). As the lug 36 starts to enter groove 28 (see FIG. 8), angular corner 40 proximate ramp 30 is compressed by lug 36 which lug is also compressed. Because both lug and corner 40 are not compressed beyond their memory, as lug 36 continues downwardly into groove 28 lug 36 partially resumes its initial configuration while corner 40 resumes its configuration. Because the width of lug 36 is greater than the depth of groove 28 by several thousandths of an inch at the centre of the lug, the outer several thousandths of an inch of the lug at the centre engages with, is compressed by, and compresses, wall 32 (see FIGS. 5 and 9). As is apparent, only a small portion of wall 32 is engaged by the central several thousandths of an inch of the lug creating the radial seal. An compressed material that is displaced because of the relative sizes of the lug and groove is accommodated by the groove 28.

Because ledge 34 extends beyond the outer extent of lug 36 by a substantial amount, axial forces pushing the cups together will be resisted by the thickness of the wall 14 below ledge 34.

Forces tending to separate the cups cause the compressed lug 36 to be moved along wall 32 towards ramp 30 until the upper portion of lug 36 engage ramp 30 which ramp stops further upward movement. At that position the seal is maintained between the central portion of lug 36 and wall 32. Where further forces are applied to rim 22 (as by a dispensing mechanism, for example that shown in Canadian Pat. No. 1,180,359) to separate the bottom cup 12 from the stack of cups 10, the lower cup is pushed down causing ramp 30 to engage the upper part of lug 36 which ramp 30 and angular corner 40 provide a shallow angle between the wall 32 and wall surface 14A providing minimal resistance thereby permitting the lug to be compressed (but not to the point where it breaks off) as it leaves the ramp.

As many changes could be made to the embodiment of the invention without departing from the scope of the invention, it is intended that all matter contained herein be interpreted as illustrative of the invention and not in a limiting sense.

The embodiments of the invention in which an exclusive property or privilege is claimed are as follows:

1. A resilient, yieldable, nestable, tapered, foamed thermoplastic container or cup, each cup or container having an endless groove and endless lug extending from the inside and outside surfaces of the container or cup wall, the groove penetrating the container or cup wall through either the inner or outer surface of the cup wall a predetermined distance from the bottom of the container or cup, the endless lug extending from the other surface of the cup wall for locking in the groove of a like container or cup when nested with the other container or cup, the endless lug extending a distance from the cup wall greater than the distance the groove penetrates into the cup wall by about several thousandths of an inch (a few thousandths of a centimeter), the groove comprising a horizontally extending lower locating ledge for preventing a cup nesting therewith being pushed in below the ledge, a substantially vertically extending intermediate sealing surface meeting an entry/retraining ramp which allows the lug to be gradually introduced into the groove and then inhibits axial separation, the ramp being angled to the vertical at an angle greater than about 10 degrees, the lug being rounded in cross-section and being radially compressible when it engages the intermediate sealing surface to seal the two together, the vertical height of the groove from the ledge and thus the height of the intermediate sealing surface being greater than the height of the lug to ensure there is no axial force on the lug when accommodated by the groove and only a central narrow portion of the lug engages the intermediate sealing surface to provide a narrow intense pressure area between the cups so that any compressed lug material is displaced in the groove which groove accommodates displaced compressed material whereby the creation of a radially extending seal being in the form of a narrow band between the lug and sealing surface is facilitated between two cups or containers (without undue distortion or compression of the expanded thermoplastic material) providing a clearance between the lug and the entry/-retaining ramp and lower locating ledge, and which cups or containers are easily separated without the breaking off of lug material.

2. The cup or container of claim 1, wherein the maximum width of the lug is proximate the centre of the lug.

3. The cup or container of claim 1, wherein the ramp angle is between about 10 degrees and about 45 degrees to the vertical.

4. The cup or container of claim 3, wherein the ramp angle is about 15 degrees to the vertical.

5. The cup or container of claim 2, wherein the ramp angle is between about 10 degrees and about 45 degrees to the vertical.

6. The cup or container of claim 5, wherein the ramp angle is about 15 degrees to the vertical.

7. The cup or container of claim 1, wherein the groove penetrates the outside surface of the container or cup wall, the endless lug extends inwardly from the inside surface of the cup wall and is of an inner diameter at its maximum width slightly less than the diameter of the groove at its maximum penetration into the container or cup wall, the entry/retaining ramp of the groove is adjacent the bottom of the groove and that part of the groove wall extends upwardly and radially inwardly to the intermediate sealing surface of the groove.

8. The cup or container of claim 1, wherein the groove penetrates the inside surface of the container or cup wall, the endless lug extends outwardly from the outside surface of the container or cup wall and is of an outer diameter at its maximum width slightly greater than the diameter of the groove at it maximum penetration into the container or cup wall, the entry/retainer ramp is at the top of the groove and that part of the groove extends downwardly and radially outwardly to the intermediate sealing surface.

9. The cup or container of claim 7, wherein the maximum width of the lug is proximate the centre of the lug.

10. The cup or container of claim 8, wherein the maximum width of the lug is proximate the centre of the lug.

11. The cup or container of claim 7, wherein the ramp angle is between about 10 degrees and about 45 degrees to the vertical.

12. The cup or container of claim 8, wherein the ramp angle is between about 10 degrees and about 45 degrees to the vertical.

13. The cup or container of claim 11, wherein the ramp angle is about 15 degrees to the vertical.

14. The cup or container of claim 12, wherein the ramp angle is abut 15 degrees to the vertical.

15. The cup or container of claim 9, wherein the ramp angle is between about 10 degrees and about 45 degrees to the vertical.

16. The cup or container of claim 10, wherein the ramp angle is between about 10 degrees and about 45 degrees to the vertical.

17. The cup or container of claim 15, wherein the ramp angle is about 15 degrees to the vertical.

18. The cup or container of claim 16, wherein the ramp angle is about 15 degrees to the vertical.

19. The cup or container of claim 4, wherein the ramp is about 0.5 mm in length.

20. The cup or container of claim 6, wherein the ramp is about 0.5 mm in length.

21. The cup or container of claim 13, wherein the ramp is about 0.5 mm in length.

22. The cup or container of claim 14, wherein the ramp is about 0.5 mm in length.

23. The cup or container of claim 17, wherein the ramp is about 0.5 mm in length.

24. The cup or container of claim 18, wherein the ramp is about 0.5 mm in length.

* * * * *